US005625385A

United States Patent [19]

Suzuki

[11] Patent Number: 5,625,385

[45] Date of Patent: Apr. 29, 1997

[54] INK JET RECORDING APPARATUS

[75] Inventor: Takashi Suzuki, Kanagawa, Japan

[73] Assignee: Fuji Xerox Co., Ltd., Tokyo, Japan

[21] Appl. No.: 229,224

[22] Filed: Apr. 18, 1994

[30] Foreign Application Priority Data

Apr. 19, 1993 [JP] Japan ..... 5-115361

[51] Int. Cl.[6] ..... B41J 2/165

[52] U.S. Cl. ..... 347/24; 347/30

[58] Field of Search ..... 347/30, 29, 24, 347/22

[56] References Cited

U.S. PATENT DOCUMENTS

| | | | |
|---|---|---|---|
| 4,952,947 | 8/1990 | Kyoshima | 346/140 R |
| 5,018,884 | 5/1991 | Hirano et al. | 347/24 |
| 5,086,305 | 2/1992 | Terasawa | 347/30 |

FOREIGN PATENT DOCUMENTS

| | | | |
|---|---|---|---|
| 59-078858 | 5/1984 | Japan | 347/24 |
| 4-344258 | 11/1992 | Japan | 347/36 |

*Primary Examiner*—John E. Barlow, Jr.
*Attorney, Agent, or Firm*—Finnegan, Henderson, Farabow, Garrett & Dunner, L.L.P.

[57] ABSTRACT

An color ink jet recording apparatus with a plural recording heads, comprises: a plural caps corresponding to the recording heads; a plural cap opening/closing drive units; a single negative pressure suction unit communicating with the respective caps through ink suction passages; a plural passage communicate/interrupt units for communicating or interrupting the respective ink suction passages; a plural air open/interrupt units; a capping control unit for controlling each passage communicate and interrupt unit to communicate the ink suction passage corresponding to the recording head to be capped and controlling the corresponding air open/interrupt unit to open the corresponding air opening passage, and in this state, for controlling the corresponding cap opening/closing drive unit to cover the nozzle surface of the recording head to be capped with its corresponding cap; and jet performance recovery control unit, after the nozzle surface of the recording head to be capped is covered by the capping control unit, for controlling the air open/interrupt unit to interrupt the air opening passage and controlling the passage communicate/interrupt unit to interrupt the ink suction passages corresponding to other recording heads than the recording head whose jet performance is to be recovered, and for controlling the negative pressure suction unit.

6 Claims, 6 Drawing Sheets

INK JET RECORDING APPARATUS

BACKGROUND OF THE INVENTION

1. Field of the Invention

The present invention relates to an ink jet recording apparatus, and more particularly to an ink jet performance maintaining device for effective use in a color ink jet recording device which includes a plurality of recording heads.

2. Discussion of the Related Art

An ink jet recording apparatus normally includes an ink jet performance maintaining device which is used to maintain the ink jet performance of the recording apparatus.

The jet performance maintaining device, by covering the nozzle surfaces of recording heads with their caps when not in printing, restricts evaporation of ink volatile material from the nozzle portions of the recording heads when not in printing, prevents printing troubles caused by the failure to jet ink due to the increased ink viscosity, and effectively prevents dust floating in the air from attaching to the nozzle jet surfaces.

Further, the jet performance maintaining device of this type, after a recording head or an ink tank is replaced with a new one, initially fills the new recording head or ink tank with ink, or, in the maintenance thereof, removes thickening ink, dust, air bubbles and the like filled in the nozzle of the recording head so as to be able to restore the ink jet performance thereof. Also, the jet performance maintaining device includes, besides the caps for covering the nozzle surfaces of the recording heads, a negative pressure suction pump connected in communication with the caps and an exhaust ink tank connected in communication with the negative suction pump, whereby the thickening ink and the like existing in the recording heads can be sucked and collected through the caps.

A color ink jet recording apparatus, in fact, requires a plurality of recording heads respectively used to jet their corresponding color components of ink, and therefore, the jet performance maintaining device must include a plurality of caps respectively corresponding to the recording heads, and also must be able to exert a negative pressure suction force, with the recording heads being covered (that is, capped) with their corresponding caps so as to perform a jet performance recovery processing.

In this case, in a system which uses negative pressure suction pumps corresponding in number to the caps, there arises such a fundamental technical problem that the jet performance maintaining device itself is complicated. For this reason, there can be expected a system in which a single negative pressure suction pump is used in common and is connected with the respective caps via a communication tube, thereby being able to simplify the structure of the jet performance maintaining device.

However, if a jet performance recovery processing is performed in the above system, then the ink contained in all of the recording heads is sucked and collected at the same time. In other words, even when the jet performance recovery processing is to be executed only on the recording head for jetting black ink, the ink from the recording heads for jetting other color ink than the black ink will also be sucked and collected wastefully.

To solve the above problem, there has been already provided a system which additionally includes on its negative pressure suction pump side a communication system selector used to switch the communication systems of the respective caps (Japanese Patent Unexamined Publication No. Hei 2-1325).

However, in the system of the above-mentioned type, the additional provision of the communication system selector complicates the structure of the negative pressure suction pump. Further, since the negative pressure suction pump and ink suction passages respectively in communication with the caps must be switched and selected, there arises such a technical problem that it is difficult to secure the airtightness of the ink suction passages.

Also, it is true that the addition of the communication system selector makes it possible to selectively perform a jet performance recovery processing on one of the recording heads but, for example, when the jet performance recovery processing is to be performed on all recording heads, the jet performance recovery processing must be sequentially executed on the recording heads one by one, which produces a new technical problem that the time necessary to perform the jet performance recovery processing is increased.

Further, while the recording heads are not in printing, if there is executed a capping operation to close tightly the nozzle surfaces of the recording heads with the corresponding caps, then the volumes of the caps are decreased only slightly with the elastic deformation of the respective caps. This raises a problem that a very slight positive pressure will be inevitably applied to the nozzle surfaces of the recording heads, which may move back the ink existing in the nozzles.

At that time, since the recording head is kept in a state where ink is not filled in the nozzle, when the capping operation is released and a recording head printing operation is executed, there is a possibility of producing a printing failure that the ink cannot be jetted surely.

SUMMARY OF THE INVENTION

The present invention aims at solving the above-mentioned conventional technical problems. Accordingly, it is an object of the invention to provide an ink jet performance maintaining device for use in a color ink jet recording apparatus which can efficiently realize a jet performance recovery processing on a plurality of recording heads without consuming ink wastefully and also which is sure to prevent generation of a printing failure caused by a capping operation.

The above object of the invention has been achieved by provision of an ink jet performance maintaining device for use in a color ink jet recording apparatus having a plurality of recording heads, respectively, for jetting their respective color ink components according to image information, said device comprising: a plurality of caps disposed so as to correspond to said recording heads and having a sufficient size to cover the nozzle surfaces of said respective recording heads; a plurality of cap opening/closing drive means for moving said caps to said recording heads, respectively, to thereby allow the said caps to open and close said nozzles surfaces of said recording heads, selectively; a single negative pressure suction means connectable in communication with said respective caps through ink suction passages; a plurality of passage communicate/interrupt means respectively disposed in the middle of said ink suction passages of said respective cap for communicating or interrupting said respective ink suction passages; a plurality of air open/interrupt means respectively for opening or interrupting a plurality of air opening passages respectively branched formed in the middle of said respective ink suction passages; capping control means for controlling each of said passage communicate and interrupt means to communicate the ink suction passage of the cap corresponding to the recording head to be capped and controlling the corresponding air open/interrupt means to open the corresponding air opening passage, and in this state, for controlling the corresponding cap opening/closing drive means to cover the nozzle surface of said recording head to be capped with its corresponding cap; and jet performance recovery control means, after said nozzle surface of said recording head to be capped is covered by said capping control means, for controlling said air open/interrupt means to interrupt said air opening passage and controlling said passage communicate/interrupt means to interrupt the ink suction passages respectively corresponding to other recording heads than said recording head whose jet performance is to be recovered, and for controlling said negative pressure suction means to perform its suction drive operation.

According to the invention, with the above-mentioned structure, the capping control means controls the passage communicate/interrupt means to bring the ink suction passage of the corresponding cap into communication with the recording head 1 to be capped and also controls the air opening/interrupt means to open the air opening passage, and in this state, further controls the cap opening/closing drive means to cover the nozzle surface of the recording head to be capped with the corresponding cap.

Therefore, even if the cap is elastically deformed during the capping operation, the pressure within the cap is equal to the atmospheric pressure and thus there is eliminated the possibility that a positive pressure can be applied to the nozzle surface of the recording head as a result of the capping operation.

Also, the jet performance recovery control means controls, after the nozzle surface of the recording head to be capped is covered by the capping control means, controls the air open/interrupt means to interrupt the air opening passage, controls the passage communicate/interrupt means to interrupt the ink suction passages corresponding to the other recording heads than the ink suction passage whose jet performance must be recovered, and controls the negative suction pressure means 6 to execute its suction drive operation.

Therefore, among the recording heads that have been capped by the capping control means, a negative suction force is applied selectively to the nozzle surface of only the recording head whose jet performance is to be recovered, with the result that the thickening ink, dust, air bubbles and the like are sucked and collected toward the negative suction means 6 from only the selected recording head.

The above and further objects, features and advantages of the invention will appear more fully from the accompanying drawings and the following detailed description.

BRIEF DESCRIPTION OF THE DRAWINGS

FIG. 4(*b*) is a view of a state in which the cap is situated at its capping position;

FIG. 5(*b*) is a view of a state in which the passage of the flexible tube is interrupted.

DETAILED DESCRIPTION OF THE EMBODIMENTS

Description will be given hereinbelow in detail of the invention by way of the embodiments thereof shown in the accompanying drawings.

Figure 1:
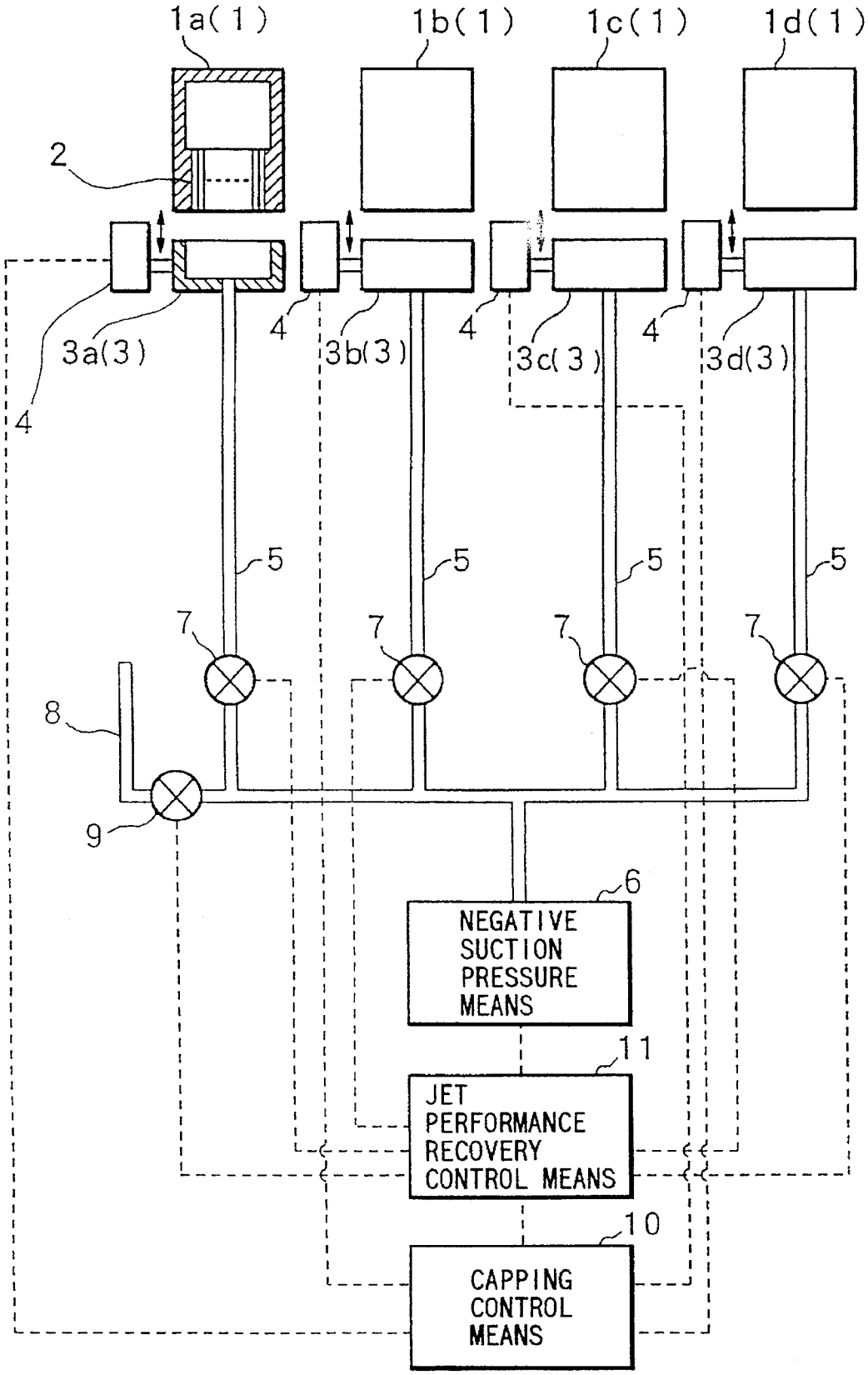
FIG. 1 is an explanatory view of the structure of a jet performance maintaining device for use in a color ink jet recording apparatus according to the invention.

In FIG. 1, a jet performance maintaining device of the invention is developed for use in a color ink jet recording apparatus having a plurality of recording heads 1 (for example, 1*a*–1*d*) respectively for jetting their respective color ink components according to image information. Thus, the device includes a plurality of caps 3 (for example, 3*a*–3*d*) respectively disposed correspondingly to the recording heads 1 and each having a sufficient size to cover the surface of the nozzle 2 of the recording head 1, a plurality of cap opening/closing drive means 4 each for relatively moving the cap 3 with respect to the recording head 1 to thereby allow the cap 3 to selectively open or close the nozzle 2 surface of the recording head 1, a single negative pressure suction means 6 connected in communication with the respective caps 3 through ink suction passages 5, a plurality of passage communicate/interrupt means 7 each disposed in the middle of the ink section passage 5 of the cap 3 for communicating or interrupting the ink suction passage 5, a plurality of air opening/interrupt means 9 respectively for opening or interrupting a plurality of air opening passages 8 respectively branched formed in the middle of the ink suction passage 5, a capping control means 10 for controlling said passage communicate/interrupt means 7 to communicate the ink suction passage 5 of the cap 3 corresponding to the recording head 1 to be capped and also controlling the air opening/interrupt means 9 to open the air opening passage 8, and, in this state, for controlling the cap opening/closing drive means 4 to cover the nozzle 2 surface of the recording head 1 to be capped, and a jet performance recovery control means 11, in a state in which the nozzle 2 surface of the recording head 1 to be capped is covered by the capping control means 10, for controlling the air opening/interrupt means 9 to interrupt the air opening passage 7 and controlling the passage communicating and interrupting means 8 to interrupt the ink suction passages 5 respectively corresponding to other recording heads 1 than the recording head 1 whose jet performance is to be recovered, and then for controlling the negative pressure suction means 6 to execute its suction operation.

In the above-mentioned technical means, as the passage communicate/interrupt means 7, for example, valve means may be disposed in the middle of the ink suction passages 5. However, from the viewpoint that airtightness must be secured between the respective ink suction passages 5 and their corresponding passage communicate/interrupt means 7, it is preferable that each ink suction passage 5 may be formed of a flexible tube which can be elastically deformed and also each passage communicate/interrupt means 7 may include a pressure member which can crush the flexible tube while the ink suction passage 5 is being interrupted.

With the above-mentioned structure, the capping control means 10 controls the passage communicate/interrupt means 7 to bring the ink suction passage 5 of the corresponding cap 3 into communication with the recording head 1 to be capped and also controls the air opening/interrupt means 9 to open the air opening passage 8 and, in this state, further controls the cap opening/closing drive means 4 to cover the nozzle 2 surface of the recording head 1 to be capped with the corresponding cap 3.

Therefore, even if the cap 3 is elastically deformed during the capping operation, the pressure within the cap 3 is equal to the atmospheric pressure and thus there is eliminated the possibility that a positive pressure can be applied to the nozzle 2 surface of the recording head 1 as a result of the capping operation.

Also, the jet performance recovery control means 11 controls, after the nozzle 2 surface of the recording head 1 to be capped is covered by the capping control means 10, controls the air open/interrupt means 9 to interrupt the air opening passage 8, controls the passage commununicate/interrupt means 7 to interrupt the ink suction passages 5 corresponding to the other recording heads 1 than the ink suction passage 5 whose jet performance must be recovered, and controls the negative suction pressure means 6 to execute its suction drive operation.

Therefore, among the recording heads 1 that have been capped by the capping control means 10, a negative suction force is applied selectively to the nozzle 2 surface of only the recording head 1 whose jet performance is to be recovered, with the result that the thickening ink, dust, air bubbles and the like are sucked and collected toward the negative suction means 6 from only the selected recording head 1.

Figure 2:
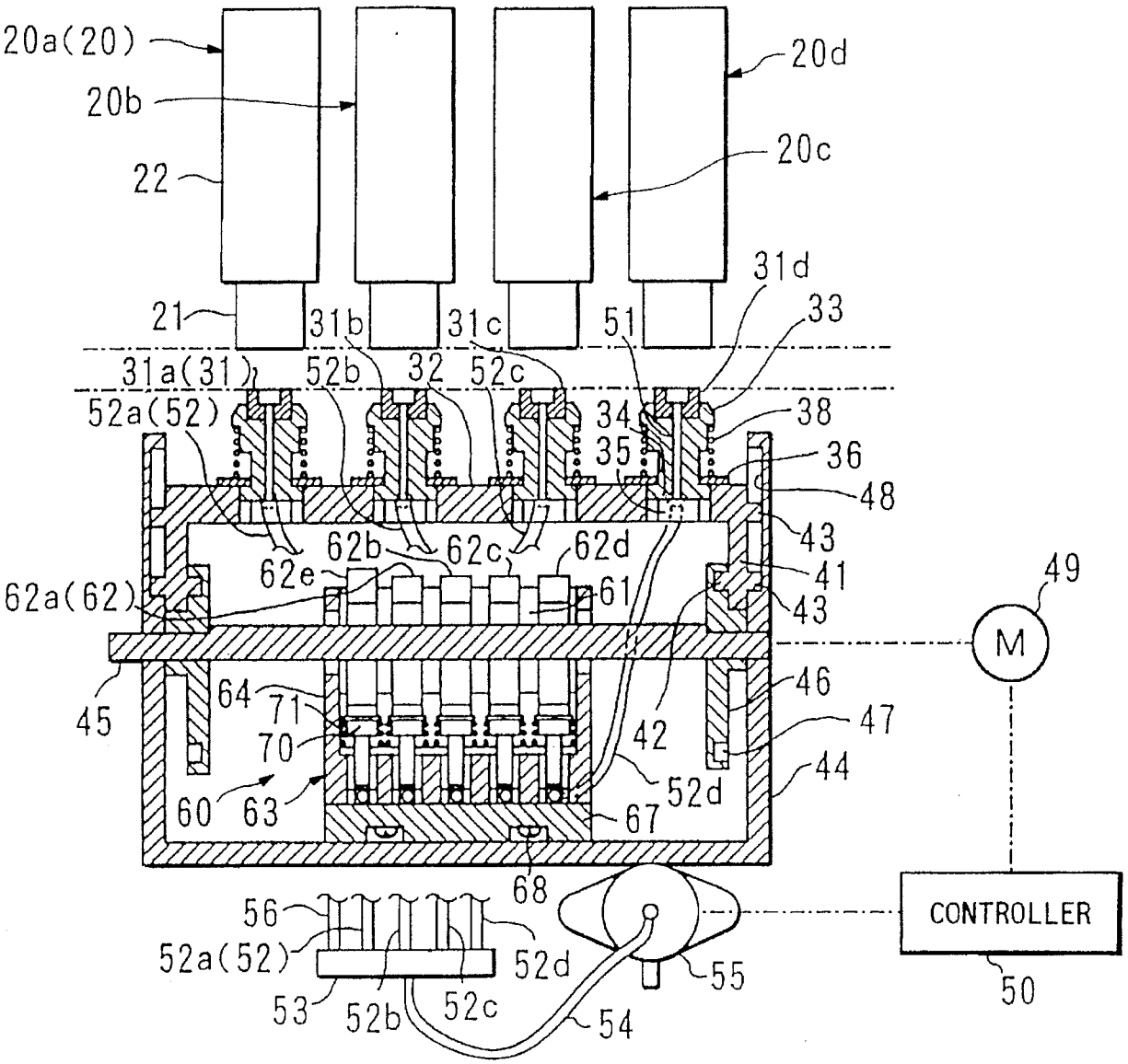
FIG. 2 is an explanatory view of the structure of a jet performance maintaining device for use in a color ink jet recording apparatus according to the above embodiment.

FIG. 2 shows an embodiment of a jet performance maintaining device employed in a color ink jet recording apparatus to which the invention is applied.

In FIG. 2, reference character 20 (in detail, 20*a*–20*d*) designates ink jet cartridges for jetting their respective ink components (in this embodiment, black [BLACK] ink, blue [BLUE] ink, red [MAGENTA] ink, and yellow [YELLOW] ink. Each of the ink jet cartridges 20 includes a recording head 21 and an ink tank 22 which is removably mounted to the recording head 21 for supply of ink. And, the ink jet cartridges 20 are carried by their respective carriages (not shown), normally stop at their respective home positions, and, in printing, are moved and scanned to jet ink onto recording paper, the ink corresponding to image signals for the respective color components.

Also, the jet performance maintaining device includes caps 31 (in particular, 31*a*–31*d*) which are respectively formed of elastic material such as rubber or the like and are disposed at positions opposed to the nozzles (not shown) surfaces of the recording heads 21 of the ink jet cartridges 21*a*–20*d*.

Figure 3:
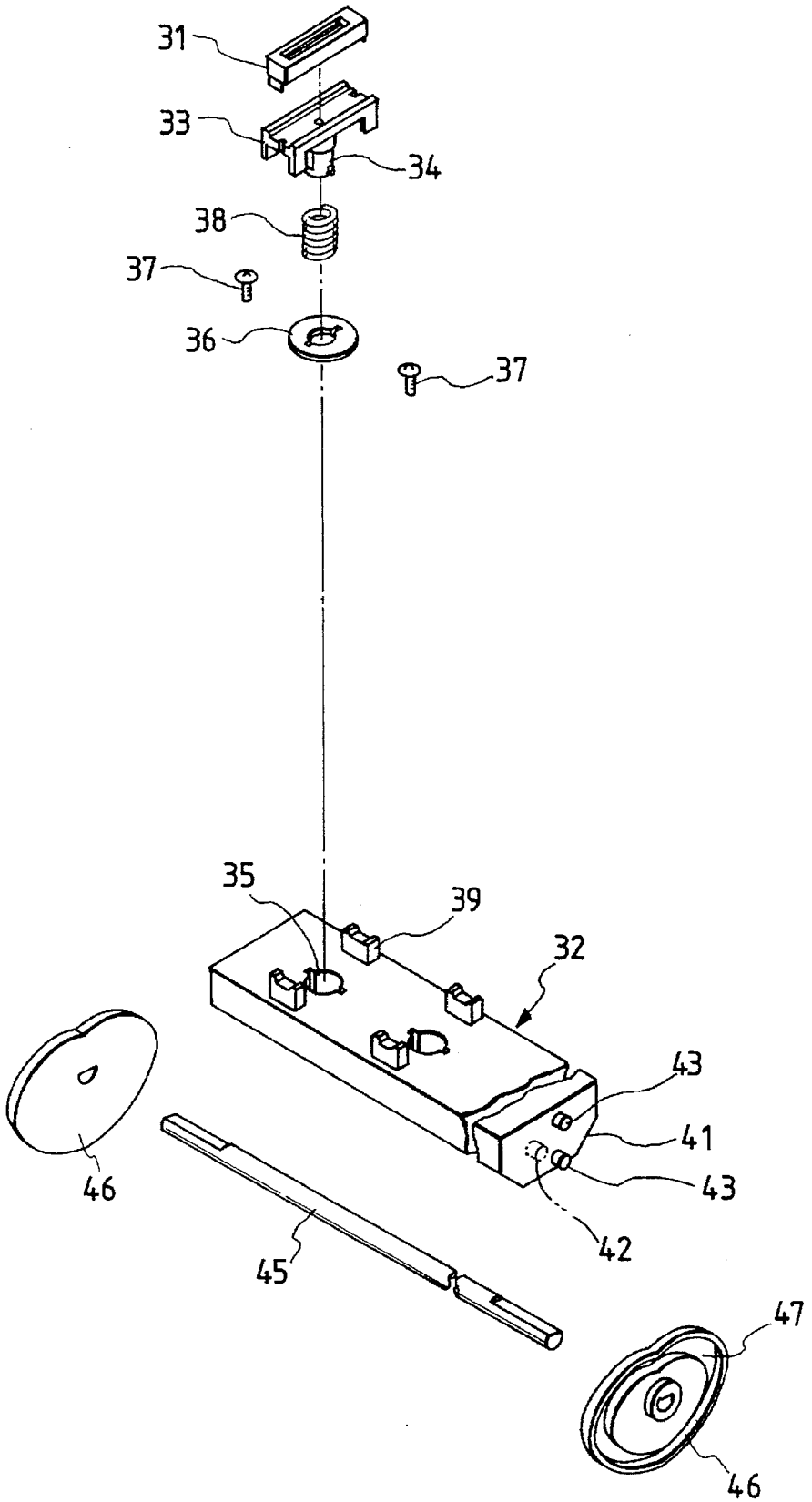
FIG. 3 is an exploded perspective view of a cap supporting structure according to the above embodiment.

The cap 31, especially as shown in FIG. 3, is mounted to a support base 32 through a cap holder 33. The cap holder 33 includes a positioning boss 34 in the lower portion thereof. The positioning boss 34 is inserted unrotatably but vertically movably into a positioning hole 35 opened up in the support base 32 and is prevented against removal by a removal preventive ring 36 which is fixed to the support base 32 by a screw 37. And, the positioning boss 34 and thus the cap holder 33 is elastically supported by a compression spring 38 which is interposed between the removal preventive ring 36 and cap holder 33. Here, reference character 39 designates a stopper which is used to restrict the position of the cap holder 33 when the nozzle surface of the recording head 21 is covered with the cap 31.

Also, the support base 32 includes two leg places 41 which are respectively formed in the two longitudinal end portions of the support base 32 and extend downwardly. An inner guide pin 42 is provided on and projected from the inner surface of each leg piece 41 and two outer guide pins 43 are provided on and projected from the outer surface of each leg piece 41.

Further, a rotary shaft 45 is rotatably supported by a channel-like frame 44 which is opened upwardly and the rotary shaft 45 can be moved by a given angle by a drive motor 49 in accordance with a drive control signal from a controller 50. And, two eccentric cams 46 each having a substantially heart-like shape are respectively fixed to the two end portions of the rotary shaft 45 within the frame 44. Each of the eccentric cams 46 includes a substantially heart-shaped guide groove 47 on the frame 44 side thereof. The inner guide pin 42 is slidably engaged into the guide groove 47. On the other hand, the frame 44 includes on the inner surfaces thereof two guide grooves 48 which extend in the vertical direction, respectively. The two outer guide pins 42 are respectively engaged into the guide grooves 48 in such a manner that they can be freely slid in the vertical direction.

Figures 4A, 4B:
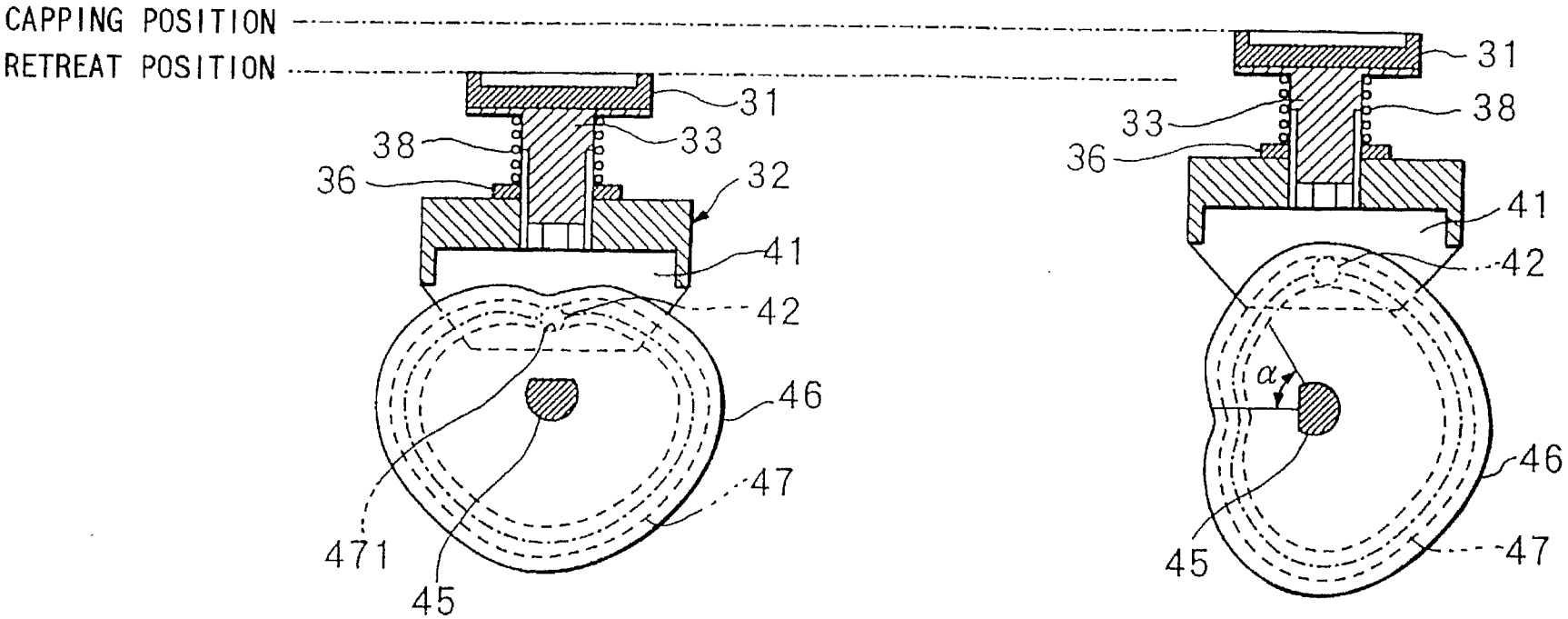
FIG. 4(*a*) is a view of a state in which a cap is situated at its retreat position.
Figure 6:
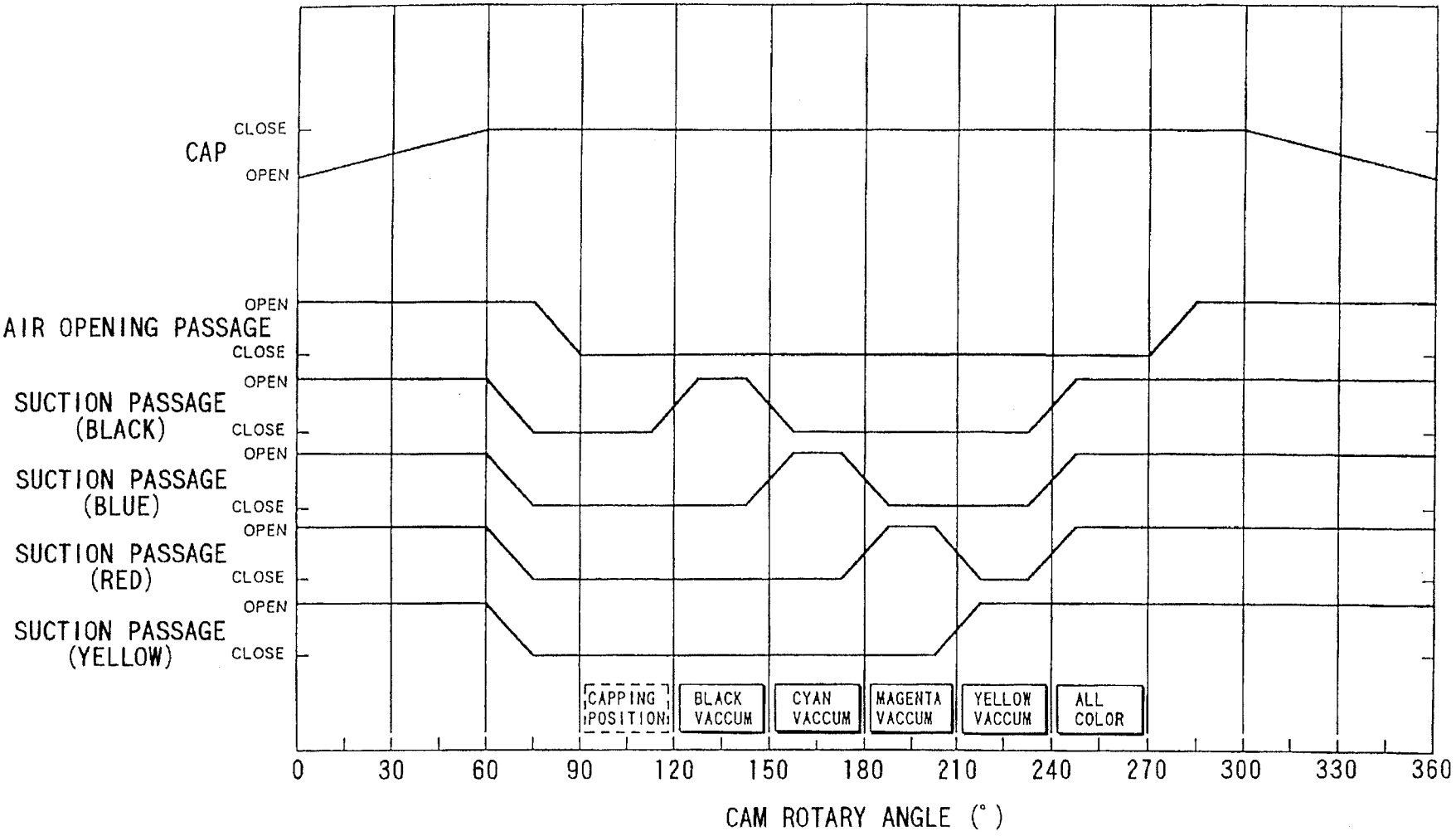
FIG. 6 is a timing chart to show relationships between caps, the ink suction passages of the respective flexible tubes, the states of the air opening passage, and the angles of rotation of a cam.

In particular, in the present embodiment, as shown in FIG. 4(*a*), when the inner guide pin 42 is situated in a bent portion 471 which is the nearest initial point from the center of rotation of the heart-shaped guide groove 47 of the eccentric cam 46, the cap 31 is set at a retreat position spaced apart from the nozzle surface of the recording head 21. On the other hand, as shown in FIG. 4(*b*), when the inner guide pin 42 is slid along the heart-shaped guide groove 47 of the eccentric cam 46 and is situated in the range of $\alpha$ (in this embodiment, 60°) to 360°–$\alpha$ from the initial point, the support base 32 is lifted up and the cap 31 can be set at a capping position to close the nozzle surface of the recording head 21. That is, a relationship between the opening/closing condition of the cap 31 and the eccentric angle of the eccentric cam is as shown in FIG. 6. Here, FIG. 4(*b*) shows a state in which the inner guide pin 42 is shifted 90° from the initial point.

Also, discharge passages 51 are respectively formed in the respective caps 31 and cap holders 33, and flexible tubes 52 (in particular, 52*a*–52*d*) are respectively connected to the respective discharge passages 51. And, the respective flexible tubes 52 are connected to a hollow joint member 53 with which a negative pressure suction pump 55 is connected in communication through a common flexible tube 54. And, the negative pressure suction pump 55 is adapted to perform a suction drive operation in accordance with a suction drive signal from a controller 50. Further, a discharge ink tank (which is not shown) for collecting discharge ink sucked when the piston is pushed back is connected in communication to the negative pressure suction pump 55.

In addition, a flexible tube 56 for air opening is connected in communication to the joint member 53.

Also, according to the present embodiment, in the central portion of the rotary shaft 45, there is provided a passage communicate/interrupt mechanism 60 which is used to open an close the passages of the respective flexible tubes 52 (52*a*–52*d*) and 56.

Figure 5B:
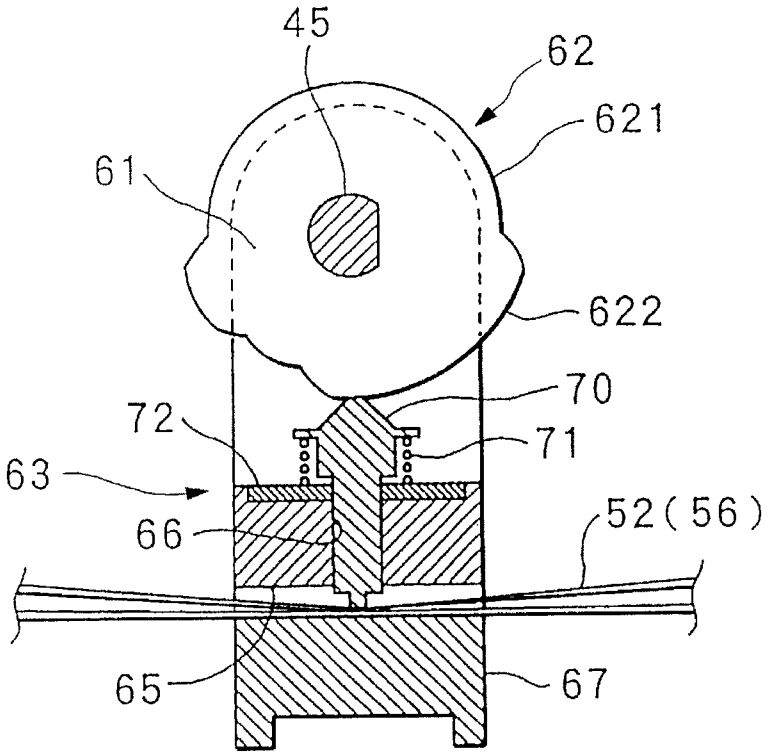
FIG. 5(*a*) is a view of a state in which the passage of a flexible tube is kept in a communication condition.
Figure 5A:
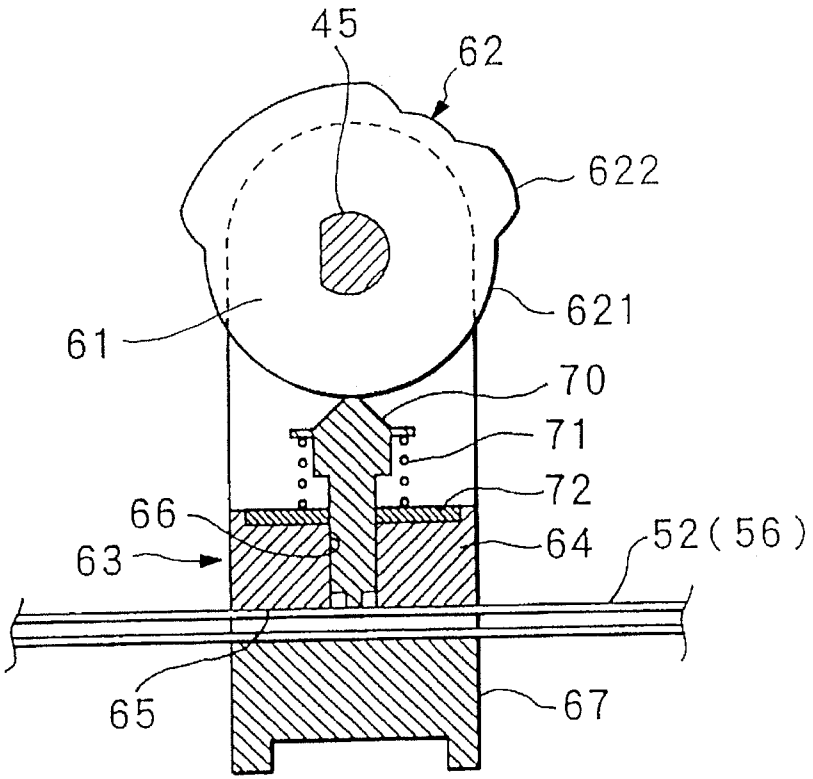

That is, according to the passage communicate and interrupt mechanism 60, as shown in FIGS. 2 and 5, a cylindrical cam 61 is fixed integrally to the rotary shaft 45, an eccentric cam surface 62 (in particular, 62*a*–62*e*) having 5 kinds of undulated patterns is formed on the peripheral surface of the cylindrical cam 61; there is provided a tube holder 63 consisting of upper and lower holders 64 and 67 for holding the five flexible tubes 52 (52*a*–52*d*) and 56; in the bottom portion of the upper holder 64, there are formed recessed storage grooves 65 respectively for storing the respective flexible tubes 52 (52*a*–52*d*) and 56, there are also formed through holes 66 which respectively extend through the upper holder 64 in a vertical direction correspondingly to the substantially central portions of the respective recessed storage grooves 65, and the upper holder 64 and lower holder 67 are fixed by screws 68; and, further, passage opening/closing pins 70 are respectively stored in the through holes 66 of the tube holder 64 in such that the pins 70 are free to advance to and retreat from the areas of the respective recessed storage grooves 65, and the head portions of the respective passage opening/closing pins 70 are always elastically abutted on the eccentric cam surface 62 (in particular, 62*a*–62*e*) by compression springs 71. In the FIGS. 2 and 5, reference character 72 designates a mounting plate which supports the respective passage opening/closing pins 70 elastically by means of the compression springs 71 and also screws the pins 70 to the upper holder 64 fixedly.

And, according to the passage communicating and interrupting mechanism 60, when the head portion of the passage opening/closing pin 70 is in elastic contact with a recessed surface 621 close to the center of rotation of the eccentric cam surface 62, as shown in FIG. 5(*a*), the tip end portion of the passage opening/closing pin 70 is stored in the through hole 66 and is held in non-contact with the flexible tube 52 (or 56) within the recessed storage groove 65 to thereby keep the passage of the flexible tube 52 (or 56) in a communicating state. Also, when the head portion of the passage opening/closing pin 70 is in elastic contact with a projected surface 622 spaced apart from the center of rotation of the eccentric cam surface 62, as shown in FIG. 5(*b*), the tip end portion of the passage opening and closing pin 70 advances into the recessed storage groove 65 and crushes the flexible tube 52 (or 56) to thereby interrupt the passage of the flexible tube 52 (or 56).

Further, the undulated patterns of the respective eccentric cam surfaces 62 of the cylindrical cam 61, for example, as shown in FIG. 6, are determined according to the opening/closing patterns of the respective flexible tubes (52*a*–52*d*) and 56.

Describing in particular, the ink suction passage of the flexible tube 52*a* corresponding to the recording head 21*a* for jetting black ink is arranged such that it is interrupted at the time when the cylindrical cam 61 is rotated 75° from its initial point (the same position as the above-mentioned initial point of the eccentric cam 46), and also that it is kept in communication at the time when the cylindrical cam 61 reaches an angle of 135° and when it is present at and from an angle of 255°.

Also, the ink suction passage of the flexible tube 52*b* corresponding to the recording head 21*b* for jetting blue ink is arranged such that it is interrupted when the cylindrical cam 61 is rotated 75° from its initial point and is kept in communication when the cam 61 arrives at an angle of 165° and when it is at and from an angle of 255°.

Further, the ink suction passage of the flexible tube 52*c* corresponding to the recording head 21*c* for jetting red ink is arranged such that it is interrupted when the cylindrical cam 61 is rotated 75° from its initial point and is kept in communication at the time when the cam 61 reaches an angle of 195° and when it is present at and from an angle of 255°.

Moreover, the ink suction passage of the flexible tube 52*d* corresponding to the recording head 21*d* for jetting yellow ink is arranged such that it is interrupted when the cylindrical cam 61 is rotated 75° from its initial point and is kept in communication at and from an angle of 225°.

In addition, the air opening passage of the flexible tube 56 is arranged such that it is interrupted when the cylindrical cam 61 is rotated 90° from its initial point and is again returned back to a communication state at and from an angle of 285°.

Next, description will be given below of the operation of the jet performance maintaining device for use in a color ink jet recording apparatus according to the present embodiment.

Referring first to a capping operation step, as shown in FIGS. 2 and 6, the rotary shaft 45 is started to rotate by the drive motor 49 in accordance with a drive control signal from the controller 50 and, when the rotary shaft 45 is rotated 60° from its initial point, the caps 31 are moved from their respective retreat positions to their respective capping positions by means of engagement between the eccentric cam 46 and support base 32, thereby closing the nozzle surfaces of the respective recording heads 21.

During the capping step, as shown in FIG. 6, although the cylindrical cam 61 is also rotated when the rotary shaft 45 is rotated, since the air opening passage is in an open state, even if the cap 31 is elastically deformed and thus the volume of the cap 31 is caused to vary when the cap 31 is abutted against the nozzle surface of the recording head 21, the pressure of the cap 31 still remains equal to the atmospheric pressure. This eliminates the possibility that a positive pressure can be applied to the nozzle surface of the recording head 21 to move back the ink in the nozzle.

Further, when the rotary shaft 45 is rotated 75° from its initial point, then the ink suction passages of the flexible tubes 52 (52*a*–52*d*) are respectively interrupted and, when the rotary shaft 45 is rotated 90°, then the air opening passage of the flexible tube 56 is interrupted. At this stage, the caps 31 are closed and cut off from the atmospheric air to thereby be able to enhance a moisture keeping effect. And, the rotary shaft 45 is held at a position which is shifted from its initial point 105°.

Next, description will be given below of an ink jet performance recovery processing step.

Now, when not in printing, it is assumed that the nozzle surfaces of all recording heads 21 are covered with the caps 31 and, for example, a jet performance recovery processing is to be performed only on the recording head 21*a* for jetting black ink.

In this case, as shown in FIGS. 2 and 6, for example, the controller 50 selects a mode select switch (not shown) to thereby execute a jet performance recovery processing only on the recording head 21*a* for jetting black ink.

That is, the controller 50 controls the rotary shaft 45, which has been already set at an angular position corresponding to a capping position (in this embodiment, a position corresponding to a position shifted 105° from its initial position), to be rotated from its initial point to a position shifted 135° therefrom and, after then, the controller 50 controls the negative pressure suction pump 55 to perform a suction drive operation.

In this instance, as shown in FIG. 6, when the rotary shaft 45 reaches the position 135° shifted from the initial point, then the respective eccentric cam surfaces 62 of the cylindrical cam 61 are also rotated, so that only the ink suction passage of the flexible tube 52*a* corresponding to the recording head 21*a* for jetting black ink is allowed to get into communication and thus is set in a state to permit the suction recovery thereof, whereas at the capping position the ink suction passages of all the flexible tubes 52, 56 and the air opening passage were interrupted.

In this state, if the negative pressure pump 55 is suction driven, then a negative suction force is applied only to the recording head 21*a* for jetting black ink and, for this reason, discharge ink including thickening ink, dust, air bubbles and the like is sucked only from the recording head 21*a* toward the negative pressure suction pump 55 and the discharge ink is then collected into a discharge ink tank (not shown).

Also, when a jet performance recovery processing is performed only on the recording head 21*b* for jetting blue ink, the controller 50 controls the drive motor 49 to rotate the rotary shaft 45 from its initial point to a position shifted 165° therefrom and thus the controller 50 allows only the ink suction passage of the flexible tube 52*b* corresponding to the recording head 21*b* to get into communication. After then, the controller 50 controls the negative pressure suction pump 55 to be suction driven.

Further, when a jet performance recovery processing is performed only on the recording head 21*c* for jetting red ink, the controller 50 controls the drive motor 49 to rotate the rotary shaft 45 from its initial point to a position shifted 195° therefrom and thus the controller 50 allows only the ink suction passage of the flexible tube 52*c* corresponding to the recording head 21*c* to get into communication. After then, the controller 50 controls the negative pressure suction pump 55 to be suction driven.

Still further, when a jet performance recovery processing is performed only on the recording head 21*d* for jetting yellow ink, the controller 50 controls the drive motor 49 to rotate the rotary shaft 45 from its initial point to a position shifted 225° therefrom and thus the controller 50 allows only the ink suction passage of the flexible tube 52*d* corresponding to the recording head 21*d* to get into communication. After then, the controller 50 controls the negative pressure suction pump 55 to be suction driven.

On the other hand, when a jet performance recovery processing is to be performed simultaneously on all of the four recording heads 21*a*–21*d*, the controller 50 controls the drive motor 49 to rotate the rotary shaft 45 from its initial point to a position shifted 255° therefrom and thus allows all of the ink suction passages of the flexible tubes 52*a*–52*d* respectively corresponding to the recording heads 21*a*–21*d*. After then, the controller 50 controls the negative pressure suction pump 55 to be suction driven.

As has been described heretofore, according to the invention, there can be fundamentally provided the following effects.

Firstly, due to the fact that passage communicate and interrupt means are respectively interposed between a plurality of caps corresponding to a plurality of recording heads and a single negative pressure suction means so as to be able to control arbitrarily communication between the respective caps and the negative pressure suction means, there is eliminated the possibility of ink being consumed uselessly, and it is possible not only to perform a jet performance recovery processing only on a specified recording head but also to realize a jet performance recovery processing on all recording heads simultaneously.

Secondly, since passage communicate and interrupt means are respectively provided in ink suction passages respectively interposed between a plurality of caps and a single negative pressure suction means to eliminate the need to provide a communication system selector on the negative pressure suction means side, there is eliminated the fear that the structure of the negative pressure suction means is complicated, and there is eliminated the need for consideration to airtightness when the negative pressure suction means and the ink suction means respectively in communication with the caps are switched and selected, so that the whole device system can be simplified.

Thirdly, due to the fact that an air opening passage is provided in the middle of ink suction passages respectively interposed between a plurality of caps and a single negative pressure suction means and also the air opening passage can be opened and closed by air opening and interrupt means, the respective ink suction passages can be air opened in a capping operation step and, even if the caps are elastically deformed in the capping operation step, there is eliminated the possibility that a positive pressure can be applied to the nozzle surfaces of the recording heads. This can surely avoid printing failures caused by an ink retreating phenomenon within the nozzles of the recording heads and also can prevent the device structure from being complicated when compared with a device in which an air opening value is provided for each of the caps.

Furthermore, according to the invention, since each of the ink suction passages is formed of a flexible tube which can be elastically deformed and a passage communicate/interrupt means includes a pressure member which can crush the flexible tube while the ink suction passage is being interrupted, it is possible to be sure to keep airtight between the respective ink suction passages and passage communicate/interrupt means.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet recording apparatus, comprising:

a plurality of recording heads with nozzle surfaces for jetting their respective different color ink components according to image information;

a plurality of independently moving caps disposed corresponding to said recording heads for covering the nozzle surfaces of said recording heads;

a plurality of cap opening/closing drive means for moving said caps to said recording heads, respectively, to allow said caps to open and close said nozzle surfaces of said recording heads, selectively;

a plurality of ink suction passages disposed corresponding to said caps;

a single means for generating suction connected to said caps through said ink suction passages;

a plurality of passage communicate/interrupt means correspondingly disposed in the middle of said ink suction passages for communicating/interrupting said ink suction passages;

a plurality of air opening passages correspondingly branched from the middle of said ink suction passages;

a plurality of air open/interrupt means for opening/interrupting said air opening passages; and capping control means for controlling each of said passage communicate/interrupt means to communicate said ink suction passage of said cap corresponding to the recording heads to be capped and controlling said corresponding air open/interrupt means to open said corresponding air opening passage, and, in this state, for controlling said corresponding cap opening/closing drive means to cover the nozzle surface of said recording head to be capped with said corresponding cap.

2. An ink jet recording apparatus, comprising:

a plurality of recording heads with nozzle surfaces for jetting their respective different color ink components according to image information;

a plurality of independently moving caps disposed corresponding to said recording heads for covering the nozzle surfaces of said recording heads;

a plurality of cap opening/closing drive means for moving said caps to said recording heads, respectively, to allow said caps to open and close said nozzle surfaces of said recording heads, selectively;

a plurality of ink suction passages disposed corresponding to said caps;

a single means for generating suction connected to said caps through said ink suction passages;

a plurality of passage communicate/interrupt means correspondingly disposed in the middle of said ink suction passages for communicating/interrupting said ink suction passages;

a plurality of air opening passages correspondingly branched from the middle of said ink suction passages;

a plurality of air open/interrupt means for opening/interrupting said air opening passages;

capping control means for controlling each of said passage communicate/interrupt means to communicate said ink suction passage of said cap corresponding to the recording heads to be capped and controlling said corresponding air open/interrupt means to open said corresponding air opening passage, and, in this state, for controlling said corresponding cap opening/closing drive means to cover the nozzle surface of said recording head to be capped with said corresponding cap; and a jet performance recovery control, operative after covering the nozzle surface of said recording head to be capped, for interrupting said air opening passage and said ink suction passages corresponding to other recording heads than said recording head being capped and selected for a jet performance recovery, and for performing a suction drive operation on said recording head being capped and selected for a jet performance recovery.

3. An ink jet recording apparatus as claimed in claim 2, wherein each of said ink suction passages is formed of an elastically deformable flexible tube, and each of said passage communicate/interrupt means includes a pressure member which can crush said flexible tube while said corresponding ink suction passage is being interrupted.

4. An ink jet recording apparatus as claimed in claim 2, wherein said passage communicate/interrupt means comprises a plurality of pins for opening/closing said corresponding ink suction passages; a plurality of compression springs for elastically supporting said corresponding pins; and a cylindrical cam having a plurality of eccentric cam surfaces with different undulated patterns, wherein said pins have an end brought in contact with said undulated patterns of said eccentric cam surfaces, and said pins have another end thereof to open/close said ink suction passages according to said undulated patterns of said eccentric cam surfaces.

5. An ink jet recording apparatus as claimed in claim 2, wherein said cap opening/closing drive means comprises a drive motor; a rotary shaft rotatable by said drive motor according to a control signal from said capping control means; a support base for supporting said caps; eccentric cams each having a predetermined shape and fixed to said rotary shaft; wherein said support base is engaged with said eccentric cams so that said caps are moved according to said predetermined shape of said eccentric cams.

6. An ink jet capping device adapted for a plurality of ink jet recording heads, comprising:

a plurality of independently moving caps disposed corresponding to said recording heads for covering nozzle surfaces of said recording heads;

a plurality of cap opening/closing drive means for moving said caps to said recording heads, respectively, to allow said caps to open and close said nozzle surfaces of said recording heads, selectively;

a plurality of ink suction passages disposed corresponding to said caps;

a single means for generating suction connected to said caps through said ink suction passages;

a plurality of passage communicate/interrupt means correspondingly disposed in the middle of said ink suction passages for communicating/interrupting said ink suction passages;

a plurality of air opening passages correspondingly branched from the middle of said ink suction passages;

a plurality of air open/interrupt means for opening/interrupting said air opening passages; and capping control means for controlling each of said passage communicate/interrupt means to communicate said ink suction passage of said cap corresponding to the recording heads to be capped and controlling said corresponding air open/interrupt means to open said corresponding air opening passage, and, in this state, for controlling said corresponding cap opening/closing drive means to cover the nozzle surface of said recording head to be capped with said corresponding cap.

* * * * *